US007255539B1

(12) United States Patent
Kunkler et al.

(10) Patent No.: US 7,255,539 B1
(45) **Date of Patent: *Aug. 14, 2007**

(54) PUMP PRESSURE LIMITING ENGINE SPEED CONTROL

(75) Inventors: Kevin J. Kunkler, Cincinnati, OH (US); John T. Whitney, Jr., Blanchester, OH (US)

(73) Assignee: Clarke Fire Protection Products, Cincinnati, OH (US)

( * ) Notice: Subject to any disclaimer, the term of this patent is extended or adjusted under 35 U.S.C. 154(b) by 457 days.

This patent is subject to a terminal disclaimer.

(21) Appl. No.: 10/829,483

(22) Filed: Oct. 9, 2003

Related U.S. Application Data

(63) Continuation-in-part of application No. 10/142,206, filed on May 9, 2002, now abandoned.

(51) Int. Cl.
*F04B 49/00* (2006.01)

(52) U.S. Cl. ..... 417/34; 417/415

(58) Field of Classification Search ..... 417/34, 417/415

See application file for complete search history.

(56) References Cited

U.S. PATENT DOCUMENTS

| | | | | | |
|---|---|---|---|---|---|
| 2,931,305 | A * | 4/1960 | Stratton | 417/34 |
| 3,797,967 | A * | 3/1974 | Howeth | 417/34 |
| 3,894,811 | A * | 7/1975 | Bergey et al. | 417/34 |
| 4,232,997 | A * | 11/1980 | Grimmer et al. | 417/4 |
| 5,174,723 | A * | 12/1992 | Groger et al. | 417/26 |
| 5,203,680 | A * | 4/1993 | Waldrop | 417/364 |
| 5,286,171 | A * | 2/1994 | Murota et al. | 417/34 |
| 5,305,680 | A * | 4/1994 | Weber | 91/1 |
| 5,479,778 | A * | 1/1996 | Toyooka et al. | 60/431 |
| 5,784,885 | A * | 7/1998 | Ishihama et al. | 60/423 |
| 2003/0210984 | A1* | 11/2003 | Whitney | 417/34 |
| 2004/0247448 | A1* | 12/2004 | Kunkler et al. | 417/34 |

* cited by examiner

*Primary Examiner*—William H. Rodriguez
(74) *Attorney, Agent, or Firm*—Thompson Hine LLP

(57) ABSTRACT

A sprinkler system for building includes an internal combustion engine which operates a water pump. The water pump in turn forces water through pipes to sprinkler heads. The engine is at least in part controlled by a throttle control mechanism which includes a spring biased piston which is moved in response to the output pressure of the pump. This prevents the pump from exceeding the rated pressure of the system components.

11 Claims, 7 Drawing Sheets

PUMP PRESSURE LIMITING ENGINE SPEED CONTROL

RELATED APPLICATIONS

This application is a continuation in part of U.S. patent application Ser. No. 10/142,206, filed on May 9, 2002, by John Whitney, titled "Pump Pressure Limiting Engine Speed Control, which application is now abandoned.

BACKGROUND OF THE INVENTION

Building sprinkler systems are designed to provide pressurized water to extinguish fires during emergency situations. A pump is used to provide the necessary water pressure. These pumps are typically powered by an electric motor, however many are often powered by internal combustion engines. The present invention relates to internal combustion engine systems only.

Such sprinkler systems are designed for a defined flow rate and pressure. For a given engine/pump combination, the discharge line pressure, from the pump, is dependent on the fluid flow rate through the system and the pressure of the water being supplied to the pump (called suction pressure). The pressure of the water at the pump suction often has a wide range between its high and low resulting in an equally wide contribution to pump output pressure variances. At a constant engine/pump RPM (Revolutions Per minute). The line pressure will increase as the fluid flow rate decreases through the system. Further, at a fixed throttle setting, as the fluid flow rate decreases, the load on the engine also decreases resulting in an increase in engine rpm, thereby further increasing pressure produced by the pump (this is referred to as the engine droop). The net effect is to increase the pressure, which a sprinkler system must be able to withstand. This basically means stronger more expensive sprinkler system components including water pipes, fittings and sprinklers. Sprinklers are rated for specific operating pressures. This establishes the limits of the system pressures. Some types of sprinklers are further limited to smaller more specific pressure ranges further limiting system pressure ranges.

SUMMARY OF THE INVENTION

The present invention is premised on the realization that the need for higher pressure rated sprinkler systems can be avoided by utilizing an engine throttle control which is responsive to the output pressure of the pump. As the pump pressure increases above a defined pressure, a control mechanism is utilized to retard the throttle, thereby reducing engine RPM and in turn maintaining a relatively constant system pressure.

Preferably the control mechanism is a piston which is attached to the throttle and forced in a direction that retards the throttle when water pressure is increased beyond a given limiting pressure. The piston is spring biased so that when the system pressure decreases, the throttle will return to its normal setting to operate the pump within design parameters. Knowing the pressure at the rated flow of the pump allows one to adjust the control mechanism to maintain this pressure even at low flow rates thereby eliminating the need for the more expensive plumbing created by undesirable pressure.

The objects and advantages of the present invention will be further appreciated in light of the following detailed description and drawings.

DETAILED DESCRIPTION OF THE INVENTION

Preferred Embodiment of The Present Invention

Figure 1:
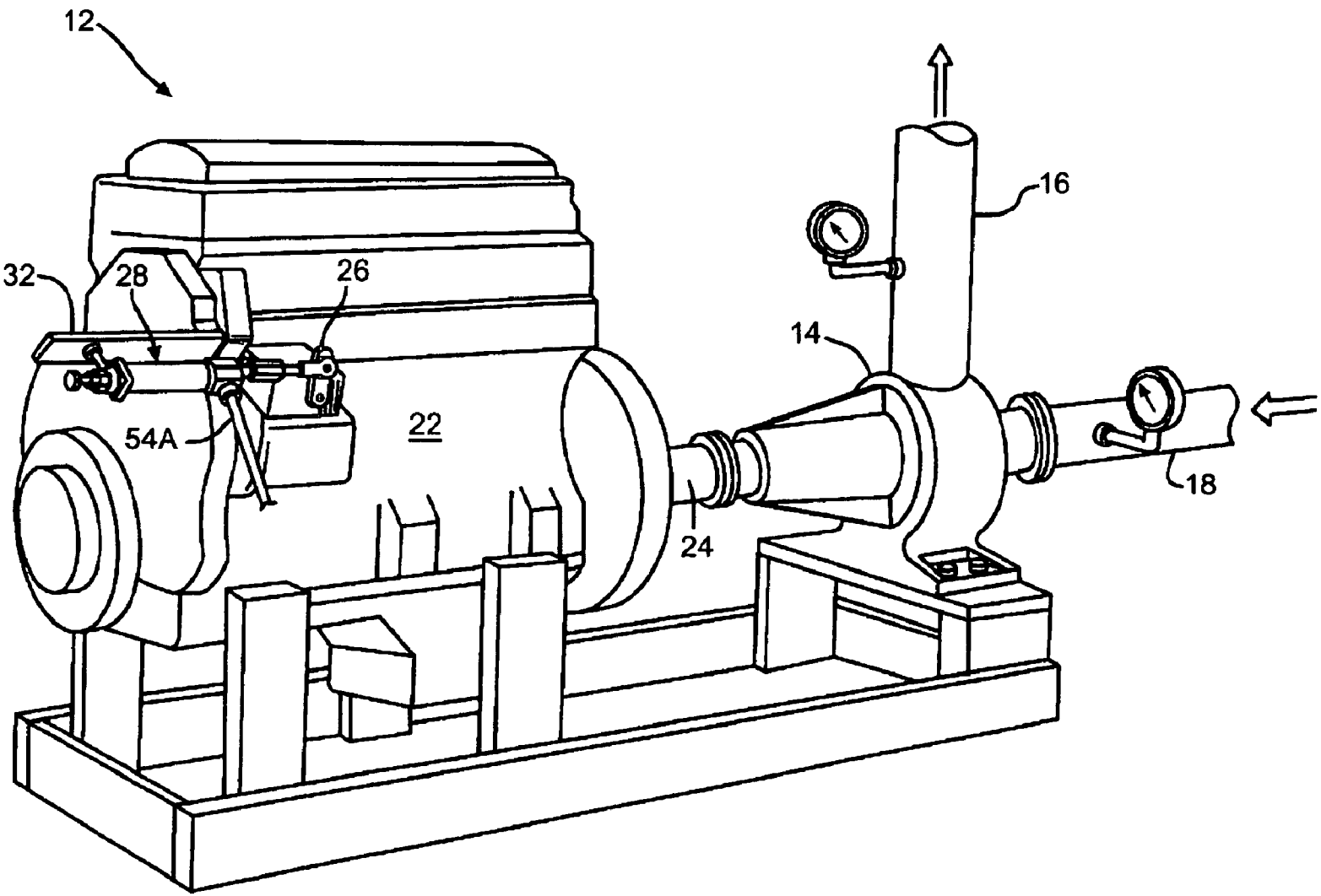
FIG. 1 presents a pictorial view of a typical internal combustion engine driven pump installation as typically used in a fire prevention sprinkler system.

FIG. 1 presents a pictorial view of a typical internal combustion engine 22 coupled to a typical fire prevention sprinkler system pump 14 that is suitable for application of the present invention.

As shown in FIG. 1, sprinkler system 12 includes a pump 14 which directs water from the pump inlet, or suction, pipe 18 and through outlet pipe 16 to sprinkler heads (not shown). The pump 14 is in turn operated by internal combustion engine 22, preferably a diesel engine. Engine 22 drives shaft 24 which in turn operates pump 14.

The RPM of engine 22 and thereby shaft 24 is controlled by throttle lever 26. Throttle lever 26 is operatively connected to a control mechanism, which is mounted on engine 22 by bracket 32. The elements of control mechanism 28 and its functional operation are described below.

Figures 2, 2A:
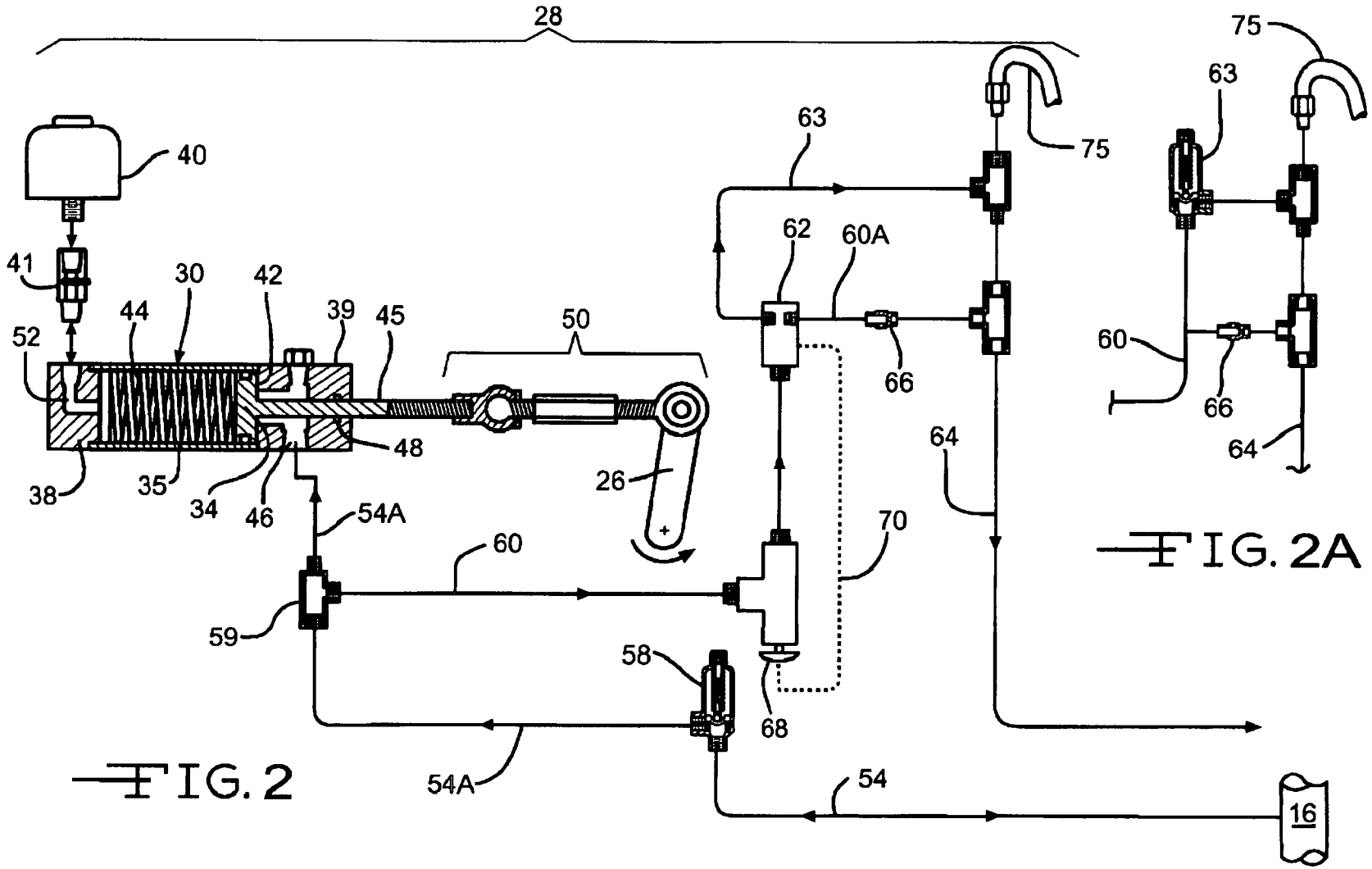
FIG. 2 presents a schematical diagram illustrating a preferred engine speed control system and its pertinent operating elements
FIG. 2A presents an alternate arrangement for the overpressure control valve which is hydraulically controlled.

Turning now to FIG. 2, throttle control mechanism 28 comprises a throttle control actuator assembly 30 fabricated from an open ended cylinder 35. A first end block 38 closes off and seals the first end of cylinder 35. A second end block 39 closes off and seals the opposite end of cylinder 35. A slidable piston 34 is received within cylinder 35 as illustrated in FIG. 2. Compression spring 44 extends from end block 38 to piston 34 thereby biasing piston 34 against shoulder 42 of end block 39 which corresponds to the full open throttle position.

Within end block 39 is fluid receiving chamber 46 A piston rod 45, integral with piston 34, extends axially through chamber 46 extending beyond end block 39, as illustrated in FIG. 2, and connects to throttle linkage 50. Piston rod 45 is appropriately sealed by an O-ring 48 thereby preventing fluid linkage around the piston rod.

A fluid dampening reservoir 40 is attached to end block 38 via orifice 41 thereby fluidly communicating with cylinder 35 through fluid channel 52 within end block 38. Orifice 41 functions to dampen fluid pressure surges in that may otherwise be transmitted directly to dampening reservoir 40.

Fluid pressure is received within fluid chamber 46, from tube 54A, and acts upon slidable piston 34 thereby compressing spring 44 whereby piston rod 45 translates to the left, as viewed in FIG. 2, thereby rotating throttle lever 26 counterclockwise thereby retarding throttle lever 26.

In operation, pump discharge pressure is received, from pump discharge 16, in line 54. Relief valve 58 is normally closed. However, if the pump discharge pressure exceeds the set point of relief valve 58, which is calibrated to maintain normally 170 psi, but may range from 10 to 240 psi, in pump discharge line 16, relief valve 58 opens thereby permitting fluid flow through line 54A, control line 60, exhaust valve 62, and through orifice 66 into drain 64. As fluid flows through orifice 66 a controlled back pressure is created in control line 60 and line 54A communicating with fluid chamber 46 in throttle actuator 30. Thus the pressure acting upon piston 34 is substantially reduced below the pump discharge pressure in pump discharge 16.

At start up and/or during normal steady state operating conditions throttle 26 and the throttle control actuator assembly 30 are positioned as illustrated in FIG. 2. Compression spring 44 is biasing piston 36 and its associated piston rod 45 to the right as viewed in FIG. 2. In this configuration throttle lever 26 is positioned in its full open position whereby pump 14 is providing a predetermined water flow rate and working pressure at rated operating speed throughout the sprinkler system, not shown, by way of discharge pipe 16. As the system is operating, the line pressure of discharge pipe 16 is also present in inlet tube 54. So long as the pressure within discharge pipe 16 and inlet tube 54 is below a pre set pressure limit of relief valve 58, typically 170 psi, relief valve 58 remains closed thereby preventing any fluid flow, or preventing enough flow against orifice 66 to create sufficient back pressure to produce movement of piston 34, into inlet line 54A that would overcome the bias from spring 44 to move the piston. Thus throttle control assembly 30 is unaffected and throttle lever 26 remains unchanged.

However, in the event line pressure in pump discharge pipe 16 and inlet tube 54 rise above the set limit of 170 psi, relief valve 58 opens thereby permitting fluid flow into inlet line 54A. Fluid flow now occurs through inlet line 54A and through control line 60, to and through exhaust valve 62, which is open to line 60A. As the fluid flow passes through line 60A, it passes through orifice 66 and into drain line 64. Orifice 66 acts to restrict the fluid flow through control line 60 thereby causing a controlled back pressure throughout control line 60 and into chamber 46, within throttle control assembly 30 by way of back pressure line 54A. Thus the fluid pressure acting upon piston 34 is greatly reduced from that of discharge pipe 16. Nevertheless as line pressure within discharge pipe 16 varies the back pressure caused by orifice 66 will also vary accordingly causing piston 34 to move against compression spring 44 thereby retarding and/or advancing throttle lever 26. Once line pressure within discharge pipe 16 drops below the set point, relief valve 58 will close thereby preventing or reducing further fluid flow through control line 54A, 60, 60A and orifice 66. Fluid pressure within the control lines will then decay to a pressure below the pressure required to overcome the bias of the spring 44 or to atmospheric, the pressure existent within drain 64. Compression spring 44 will then bias piston 34 to the right, against shoulder 42 thereby resetting throttle lever 26 to its normal operating position.

Fluid damping reservoir 40, fluidly communicating with cylinder 35 through conduit 52, is preferably provided to dampen rapid fluid pressure fluctuations that may occur within control line 54A, fluid chamber 46 and acting on piston 34.

A further method of damping pressure fluctuations that may occur in control line 54A is to place an orifice within control line 54A between relief valve 58 and fluid chamber 46 and/or between valve 58 and pump discharge 16.

During operation of the throttle control system 28, pressure switch 68 constantly monitors the fluid pressure within control line 60. In the event of orifice 66 becoming artifically restricted and the fluid pressure within control line 60 becoming artifically high, an electrical signal is transmitted through electrical connection 70 to three way exhaust valve 62 thereby opening the valve to relieve line 63 thereby dumping the fluid pressure within control line 60 and throttle control actuator assembly 30 causing piston 34 to be biased by spring 44 to the right against shoulder, thereby returning throttle 26 to its normal operating position.

Figure 3:
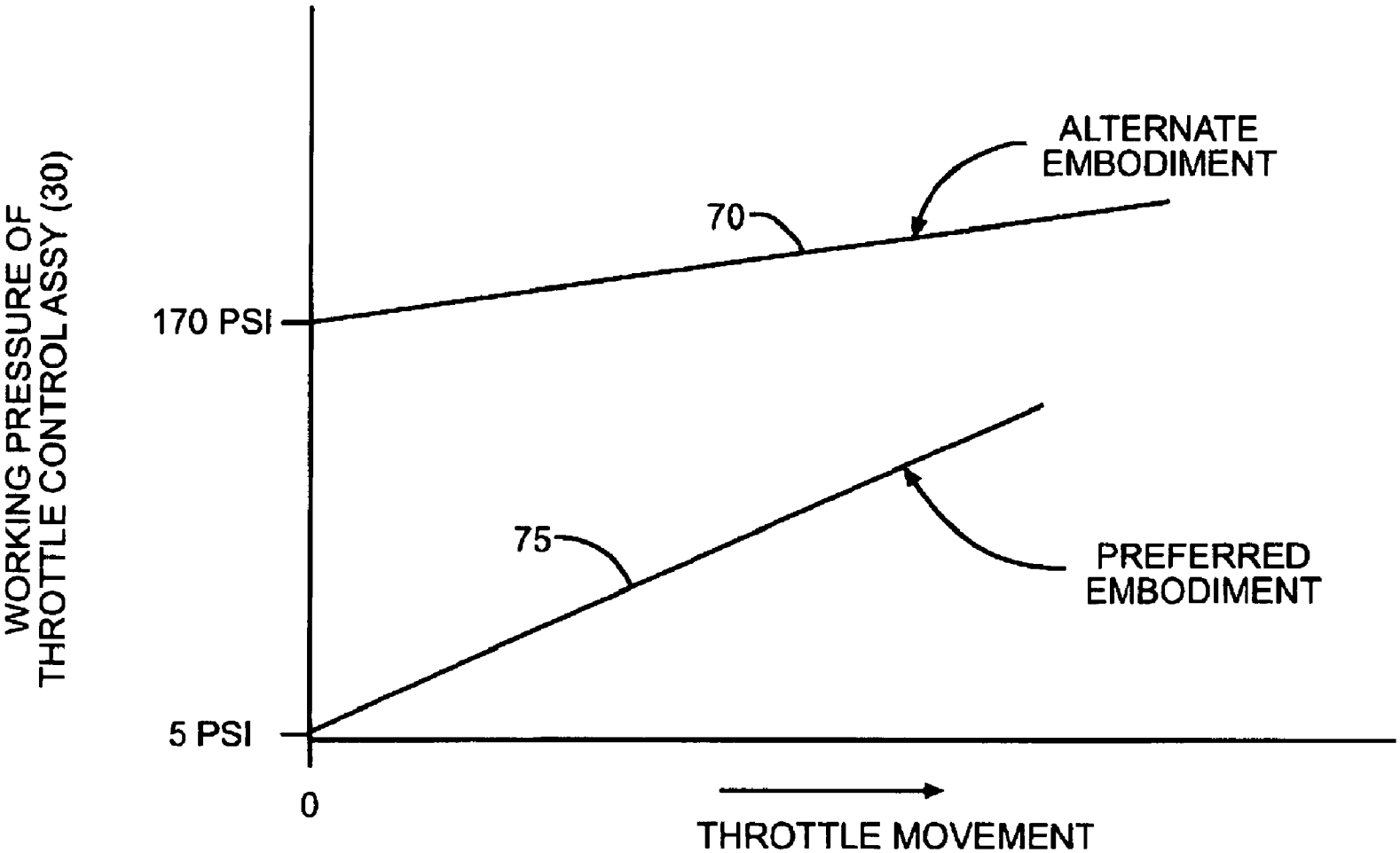
FIG. 3 presents a comparison of the fluid pressure necessary to obtain a given throttle movement for the two embodiments of the present invention presented herein

However as illustrated by curve 75 in FIG. 3, by employing the preferred embodiment of the invention, as described above, the fluid pressure acting upon piston 36 has been significantly reduced to the back pressure value created by orifice 66, within input lines 60 and 54A, as fluid passes therethrough. Thus throttle control assembly 30 need not be designed to withstand operational fluid pressures of 170 psi and above FIG. 3 presents a plot of the fluid pressure acting upon piston 34 as a function throttle movement, for a sprinkler system embodying the preferred embodiment of the present invention as described above, as compared to the fluid pressure acting upon piston 156 in the alternate embodiment of the present invention described herein below. Referring to FIG. 3, curve 75 represents a typical plot of the pressure acting upon piston 34 vs. throttle, or piston, movement and curve 70 typically represents the pressure acting upon piston 156 vs. throttle or piston movement in the alternate embodiment described below. As seen in FIG. 3 the preferred embodiment of the present invention requires a greater pressure change, or delta P than the alternate embodiment represented by curve 70. Therefore, the preferred embodiment of the present invention offers a more sensitive control of throttle movement than that offered by the alternative embodiment below.

FIG. 2A presents an alternate system for exhaust valve 62 and its associated pressure sensing switch 68. As illustrated in FIG. 2A exhaust valve 62 and pressure sensing switch 68 may be replaced by a typical, mechanically operated, pressure relief valve 63. Thus the function of exhaust valve 62 and pressure sensing switch 68 may be replaced by a mechanical as opposed to an electrically functioning pressure relief system.

As illustrated in FIG. 3, the fluid pressure acting upon piston 156 in the alternate embodiment described below, represented by curve 70, is equal to 170 psi or higher and equal to the line pressure of pump discharge-16 immediately upon the opening of the relief valve 58 and continues to climb as discharge pressure 16 climbs.

Figure 6:
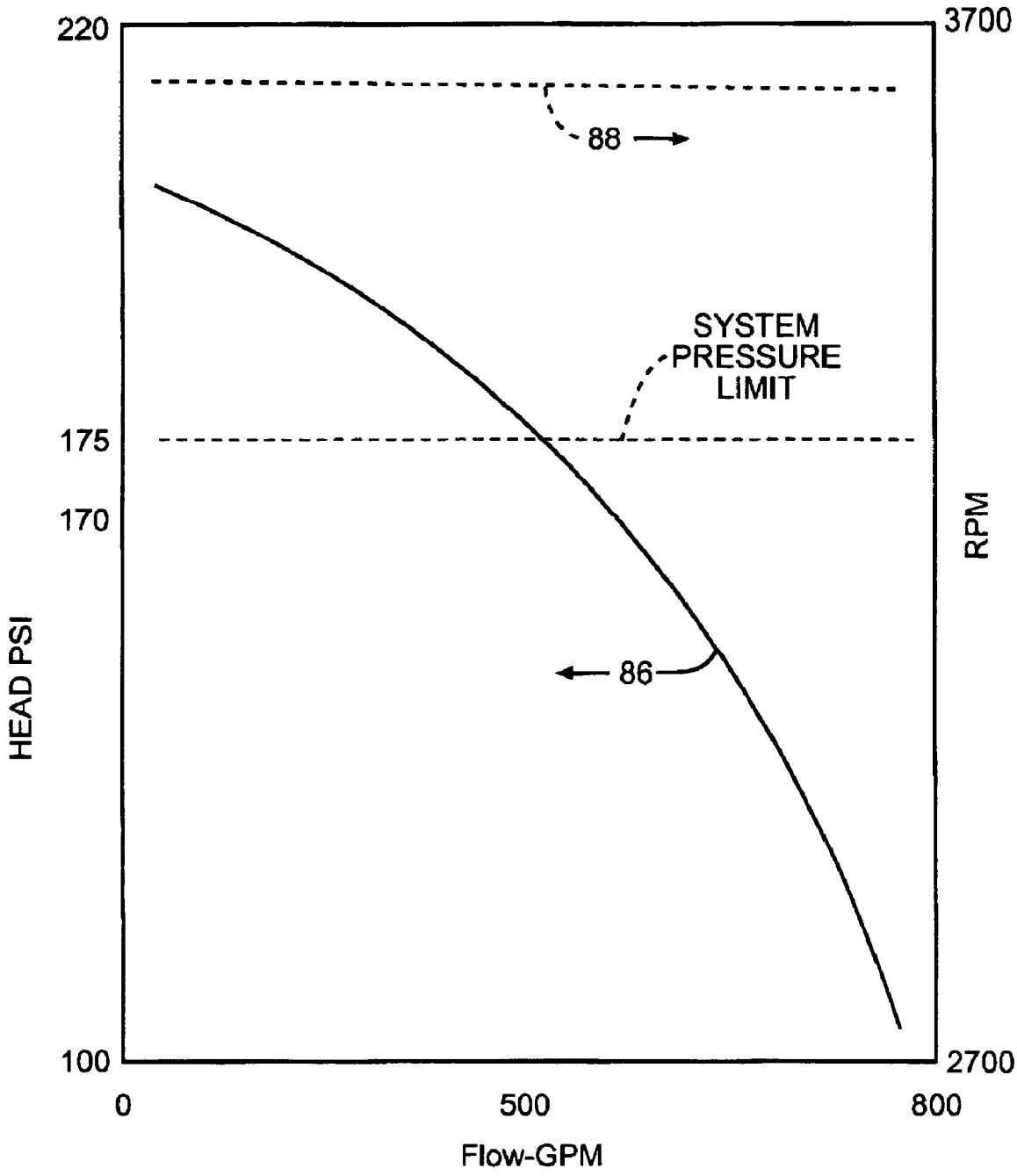
FIG. 6. presents typical system performance of flow versus system pressure and flow versus engine RPM when a throttle control mechanism is not installed on the engine.

FIG. 6 presents a plot of the fluid pressure versus flow, curve 86, within pump discharge line 16 when the system is not present. As illustrated, the pump discharge pressure significantly exceeds the system pressure limit of approximately 175 psi. Curve 88 illustrates the associated engine/pump speed versus flow.

Figure 7:
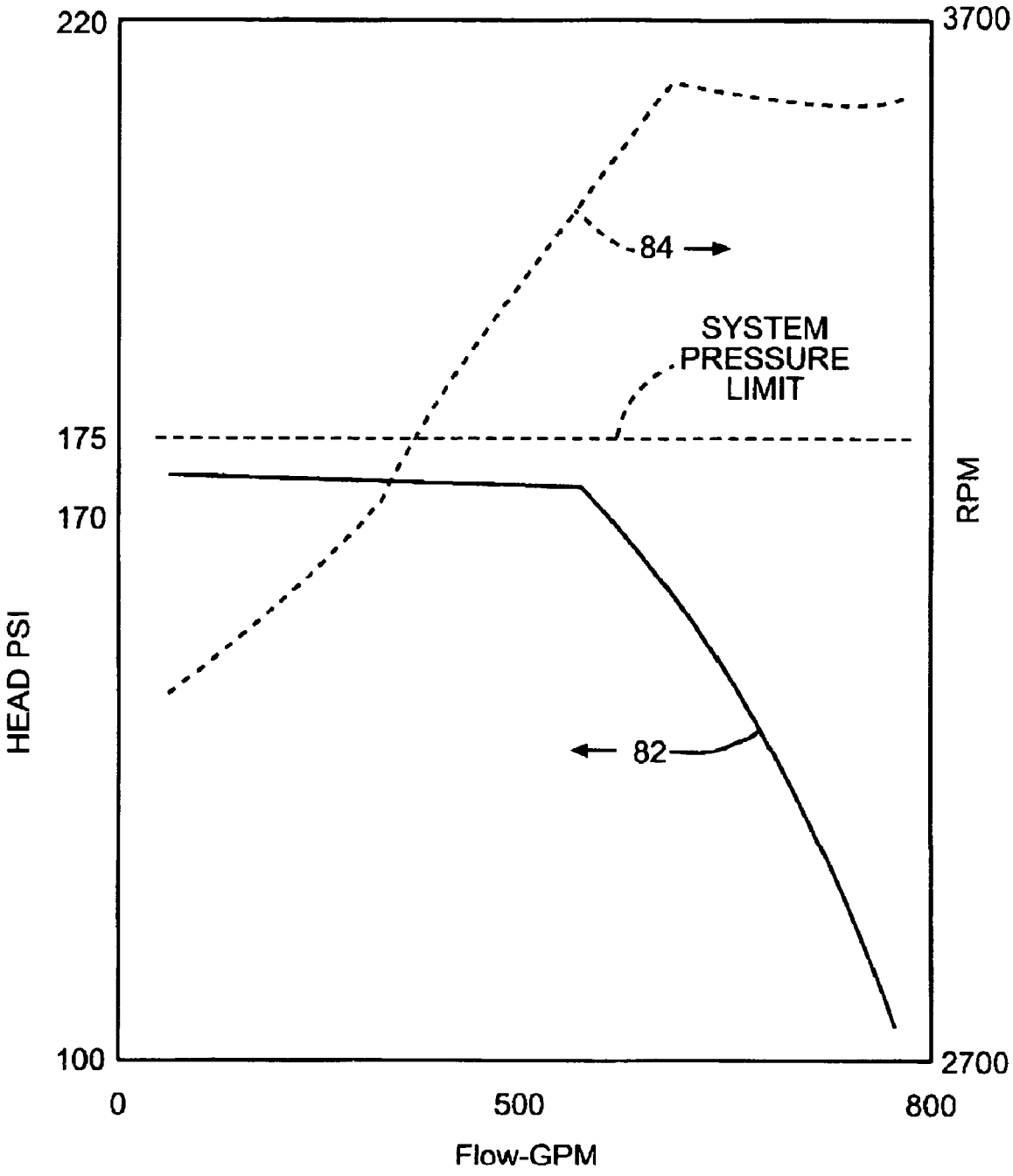
FIG. 7. presents typical system performance of flow versus system pressure and flow versus engine RPM when a throttle control mechanism is installed on the engine.

FIG. 7 presents a plot of the fluid pressure versus flow, curve 82, within pump discharge line 16 when the system is activated to overcome a pump discharge pressure reaching or exceeding the set point of 170 psi. of relief valve 58. As illustrated, the pump discharge pressure is relatively constant at about 170 psi. Curve 84 illustrates the associated engine/pump speed versus flow.

Alternate Embodiment of the Present Invention

Figure 4:
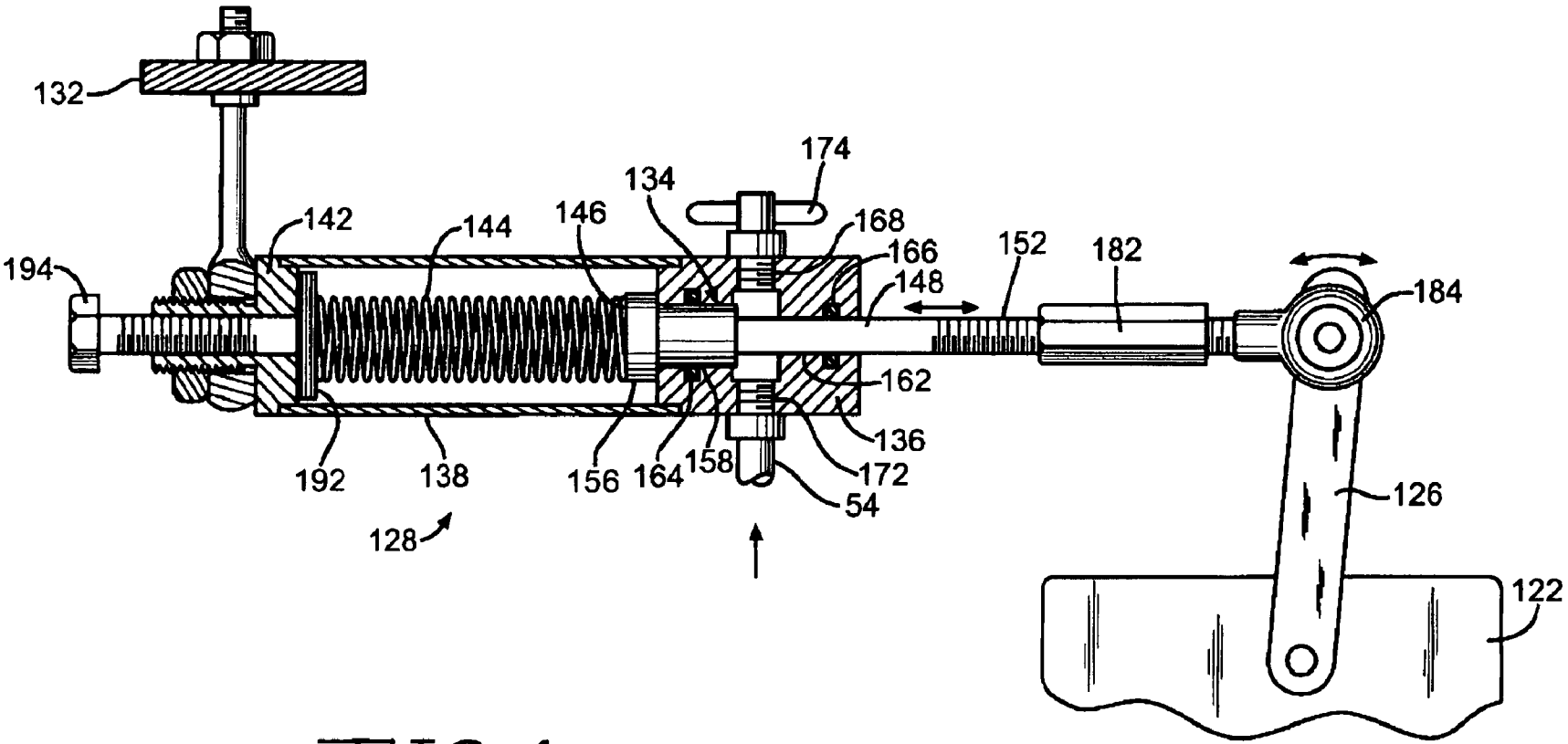
FIG. 4 presents an alternate embodiment of the present invention wherein the engine throttle is set at full throttle
Figure 5:
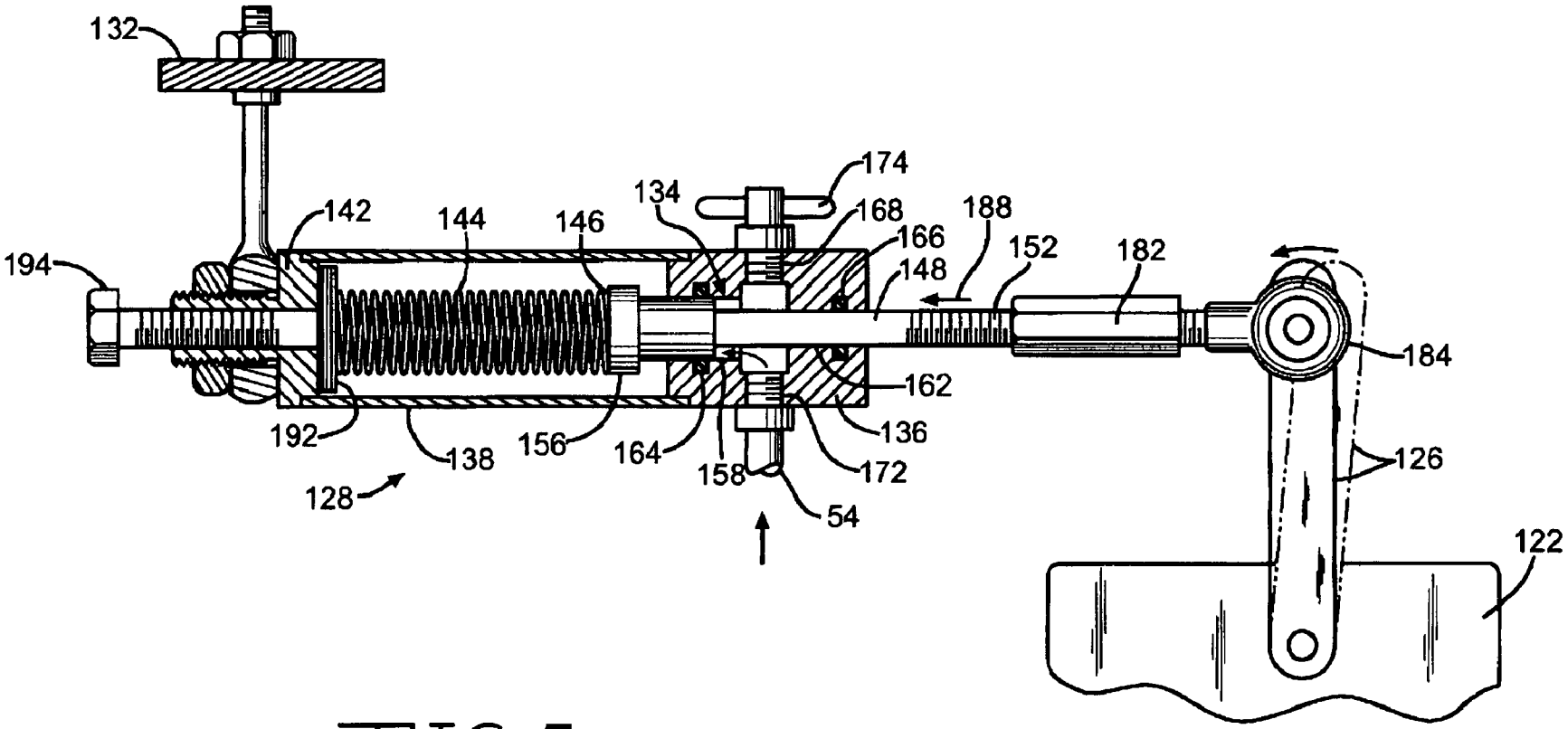
FIG. 5 presents the alternate embodiment of the present invention, illustrated in FIG. 4, wherein the engine throttle has been retarded by present invention illustrated in FIG. 4.

An alternate embodiment to the preferred embodiment described above is illustrated in FIG. 4. As illustrated in FIG. 4, an alternate embodiment control mechanism 128 includes a piston 134 which extends through a block 136. Rearwardly of block 136 is a cylindrical casing 138 which screws onto block 136. Opposite block 136 is a cap 142 which screws onto the cylindrical casing 138 holding it in position. Between the cap 142 and the piston 134 is a spring 144 which engages a rear end 146 of piston 134.

Piston 134 includes a shaft 148 having a threaded end 152. The opposite end of piston 134 terminates with a stop member 156 which in turn is larger than the piston 134.

The piston 134 rides in block 136 which includes an enlarged axial first cylindrical chamber 158 and a smaller aligned second cylindrical chamber 162. First and second o-rings 164 and 166 are seated axially in chambers 158 and 162 respectively. Piston 134 is located in the first cylindrical chamber 158 and a seal is formed between piston 134 and the wall of chamber 158 by o-ring 164. The shaft 148 of piston 134 extends through the smaller second chamber 162 and again forms a seal with o-ring 166. The stop member 156 of piston 134 is larger than the large axial chamber 158 and acts as a stop limiting the movement of piston 134 relative to block 136.

Block 136 further includes first and second threaded transverse openings, 168 and 172 respectively which lead to chamber 158. The first threaded opening 168 is sealed by a bleed valve 174. The second threaded opening 172 is connected to tube 54 which extends to pipe 16 which is downstream of pump 14 (Refer to FIG. 1). Tube 176 further includes a strainer 178.

The threaded end 152 of piston 134 attaches via turnbuckle 182 to throttle control linkage 184 which in turn is attached to the throttle 126.

In operation when the engine 22 (FIG. 1) is activated, it will cause pump 14 (FIG. 1) to rotate increasing the water pressure in pipe 16. (FIG. 1) Tubing 54 and chamber 158 of block 136. The water pressure (when it reaches a defined level) within block 136 will force the piston 134 to move to the left pulling the throttle back decreasing the rpm's for the engine and the output pressure from the pump. When the pressure is reduced below a defined pressure, the spring 144 will force the piston 134 back toward its starting position as shown in FIG. 4. The stop member 156 will engage a rear end of block 136 preventing further movement. When stop member 156 engages block 136, the throttle 126 is positioned for the engine to provide its rated speed to drive pump 14 (FIG. 1).

The present invention includes two mechanisms to adjust the operation of the control unit 128. Between cap 142 and spring 144 are one or more metal disks or shims 192 which will increase the pressure applied by the spring against the piston 134. By calculating the effect of a shim, one can determine the number of shims needed to achieve the necessary operating pressures. Alternatively, a bolt 194 could be threaded through cap 142 to adjust the pressure on spring 144 as best shown in FIG. 4. Further, turnbuckle 182 can adjust the position of throttle linkage 184 relative to shaft 152. This will permit on site adjustment which may be necessary for engine 22 speed output to be trimmed to match pump 14 speed demand The present invention provides an uncomplicated mechanism which accounts for increases in the pump pressure caused by changing flow rates, increases in pressure caused by engine droop as well as suction pressure. The simple pressure activated device of the present invention can be used to compensate for all of these automatically. The system itself does not require multiple adjustments for these three separate factors. This reduces the maximum pressure for a sprinkler system without limiting designed flow rate. Thus by utilizing the present invention, one can dramatically reduce the cost of a sprinkler system.

This has been a description of the present invention and the preferred mode of practicing the invention, however, the invention itself should only be defined by the appended claims.

We claim:

1. A throttle control mechanism for an engine driven pump, said pump having a fluid intake port and a fluid discharge port, said throttle control mechanism comprising:

a) an elongate cylinder having a first open end and a second closed end, said first end closed and fluidly sealed by an end block, b) a fluid chamber within said end block, said fluid chamber in fluid communication with said cylinder, c) a sliding piston within said cylinder, said piston including an axially extending throttle activation rod extending through said end block, said throttle activation rod connected to the throttle of said engine whereby movement of said piston, within said cylinder, causes movement of said throttle activation rod and said engine throttle, d) sealing means between said piston and said cylinder, e) biasing means between said piston and said closed end of said cylinder whereby said piston is biased against said end block, f) a first fluid communicating conduit between said fluid chamber, within said end block, and the discharge port of said pump, g) said first fluid communicating conduit having a pressure relief valve therein whereby fluid will flow from said pump discharge port to said fluid chamber within said end block, when the fluid pressure within said pump discharge port exceeds a predetermined pressure, h) a second fluid communicating conduit fluidly communicating with said first fluid communicating conduit between said relief valve and said fluid chamber within said end block, said second fluid communicating conduit fluidly communicating between said first fluid communicating conduit and the atmosphere, i) a fluid restricting orifice within said second fluid communicating conduit whereby said orifice creates a reduced fluid pressure within said first and second fluid communicating conduits and said fluid chamber, within said end block, as fluid passes therethrough.

2. The throttle control mechanism as claimed in claim 1 including:

a) an electrically operated three way exhaust valve positioned, within said second fluid communicating conduit, between said orifice and said first fluid communicating conduit, said exhaust valve having one fluid inlet port and a first and second exhaust port, said first exhaust port normally open and fluidly communicating with said orifice, said second exhaust port normally closed and having means for opening said port upon demand, b) a pressure sensing device for sensing fluid pressure within said second fluid communicating conduit, between said first fluid communicating conduit and said three way exhaust valve, whereby upon sensing a predetermined fluid pressure within said second fluid communication conduit said pressure sensing device opens said second exhaust port of said three way exhaust valve.

3. The throttle control mechanism as claimed in claim 1 including a fluid damping reservoir in fluid communication with said cylinder.

4. A building sprinkler system including the throttle control mechanism of claim 1, wherein the discharge port of said pump is connected to deliver water to sprinklers of the sprinkler system.

5. A throttle control mechanism for an engine driven pump, said pump having an intake port and a discharge port, said throttle control mechanism comprising:

a movable member, the movable member operatively connected with a throttle link and biased to place the throttle into a standard operating position, a liquid chamber adjacent the movable member, a liquid input in communication with liquid discharged from the discharge port, a path in communication with liquid that enters the liquid input, the path leading to the liquid chamber;

a liquid output path for diverting some liquid that enters the liquid input to a liquid output, and the throttle control mechanism configured to respond to liquid pressure applied at the liquid input so that when liquid pressure applied at the liquid input reaches a threshold high pressure:

(i) liquid communication between the liquid input and the path is provided, and (ii) liquid communication between the liquid input and the liquid output via the liquid output path is provided, with the liquid output responsively releasing some liquid so that a pressure condition produced in the liquid chamber via the path is reduced as compared to the threshold high pressure; and (iii) the pressure condition overcomes bias on the movable member and causes the movable member to move thereby causing the throttle activation rod to move in a throttle speed reducing direction;

wherein the liquid chamber is at one side of the movable member and the mechanism further includes a damping reservoir in fluid communication with an opposite side of the movable member.

6. The throttle control mechanism of claim 5 wherein the damping reservoir is sealed from communication with the liquid chamber.

7. The throttle control mechanism of claim 6 wherein the movable member comprises a piston within a cylinder.

8. A throttle control mechanism for an engine driven pump, said pump having an intake port and a discharge port, said throttle control mechanism comprising:

a movable member, the movable member operatively connected with a throttle link and biased to place the throttle into a standard operating position, a liquid chamber adjacent the movable member, and a liquid input in communication with liquid discharged from the discharge port, a path in communication with liquid that enters the liquid input, the path leading to the liquid chamber;

a liquid output path for diverting some liquid that enters the liquid input to a liquid output, and the throttle control mechanism configured to respond to liquid pressure applied at the liquid input so that when liquid pressure applied at the liquid input reaches a threshold high pressure:

(i) liquid communication between the liquid input and the is provided, and (ii) liquid communication between the liquid input and the liquid output via the liquid output path is provided, with the liquid output responsively releasing some liquid so that a pressure condition produced in the liquid chamber via the path is reduced as compared to the threshold high pressure; and (iii) the pressure condition overcomes bias on the movable member and causes the movable member to move thereby causing the throttle activation rod to move in a throttle speed reducing direction;

wherein the liquid input comprises a relief valve having a pressure limit set at the threshold high pressure, the liquid output comprises a flow limiting orifice.

9. A throttle control mechanism for an engine driven pump, said pump having an intake port and a discharge port, said throttle control mechanism comprising:

a movable member, the movable member operatively connected with a throttle link and biased to place the throttle into a standard operating position, a liquid chamber adjacent the movable member, and a liquid input in communication with liquid discharged from the discharge port, a path in communication with liquid that enters the liquid input, the path leading to the liquid chamber;

a liquid output path for diverting some liquid that enters the liquid input to a liquid output, and the throttle control mechanism configured to respond to liquid pressure applied at the liquid input so that when liquid pressure applied at the liquid input reaches a threshold high pressure:

(i) liquid communication between the liquid input and the path is provided, and (ii) liquid communication between the liquid input and the liquid output via the liquid output path is provided, with the liquid output responsively releasing some liquid so that a pressure condition produced in the liquid chamber via the path is reduced as compared to the threshold high pressure; and (iii) the pressure condition overcomes bias on the movable member and causes the movable member to move thereby causing the throttle activation rod to move in a throttle speed reducing direction.

10. The throttle control mechanism of claim 9 wherein the moveable member is biased by a spring.

11. A building sprinkler system including the throttle control mechanism of claim 9, wherein the discharge port of said pump is connected to deliver water to sprinklers of the sprinkler system.

* * * * *

UNITED STATES PATENT AND TRADEMARK OFFICE

CERTIFICATE OF CORRECTION

PATENT NO. : 7,255,539 B2
APPLICATION NO. : 10/829483
DATED : August 14, 2007
INVENTOR(S) : Kevin J. Kunkler et al.

It is certified that error appears in the above-identified patent and that said Letters Patent is hereby corrected as shown below:

Column 8

Line 10, After "the" insert -- path --.

Signed and Sealed this

Thirteenth Day of November, 2007

JON W. DUDAS
*Director of the United States Patent and Trademark Office*